United States Patent [19]

Görlach

[11] 4,062,453

[45] Dec. 13, 1977

[54] DEVICE FOR STORAGE OF SKIS

[76] Inventor: Hans Görlach, Lerchenfeldstrasse 14, Kaufbeuren-Neugablonz, Germany

[21] Appl. No.: 653,610

[22] Filed: Jan. 29, 1976

[30] Foreign Application Priority Data

Feb. 8, 1975 Germany ..... 2505411

[51] Int. Cl.[2] ..... A47F 7/00

[52] U.S. Cl. ..... 211/60 SK; 211/88

[58] Field of Search ..... 211/60 SK, 60 R, 60 T, 211/4, 8; 280/11.37 K; 224/42.1 R, 455

[56] References Cited

U.S. PATENT DOCUMENTS

| | | | |
|---|---|---|---|
| 1,914,276 | 6/1933 | Moore | 211/4 |
| 3,187,902 | 6/1965 | Nelson | 211/60 T |
| 3,330,573 | 7/1967 | Sieloff | 211/60 SK X |
| 3,722,652 | 3/1973 | Busch et al. | 211/60 SK X |
| 3,826,378 | 7/1974 | Novak | 211/60 SK |
| 3,848,785 | 11/1974 | Bott | 211/60 SK X |
| 3,854,641 | 12/1974 | Kohis | 211/60 SK X |
| 3,905,214 | 9/1975 | Bell | 211/60 SK X |

FOREIGN PATENT DOCUMENTS

| | | | |
|---|---|---|---|
| 268,122 | 1/1969 | Austria | 211/60 SK |
| 1,335,767 | 7/1963 | France | 211/60 SK |
| 262,303 | 6/1949 | Switzerland | 211/60 SK |

*Primary Examiner*—Roy D. Frazier
*Assistant Examiner*—Robert W. Gibson, Jr.
*Attorney, Agent, or Firm*—Holman & Stern

[57] ABSTRACT

A device for storing skis comprises a holder, which may be one of a plurality mounted on a wall, a stand, or other support, constituted by a plate with outstanding arms defining two side-by-side compartments each capable of accommodating a pair of skis. These compartments are closed by a pivotal bar or the like which can be locked in the closed position.

5 Claims, 6 Drawing Figures

FIG. 2
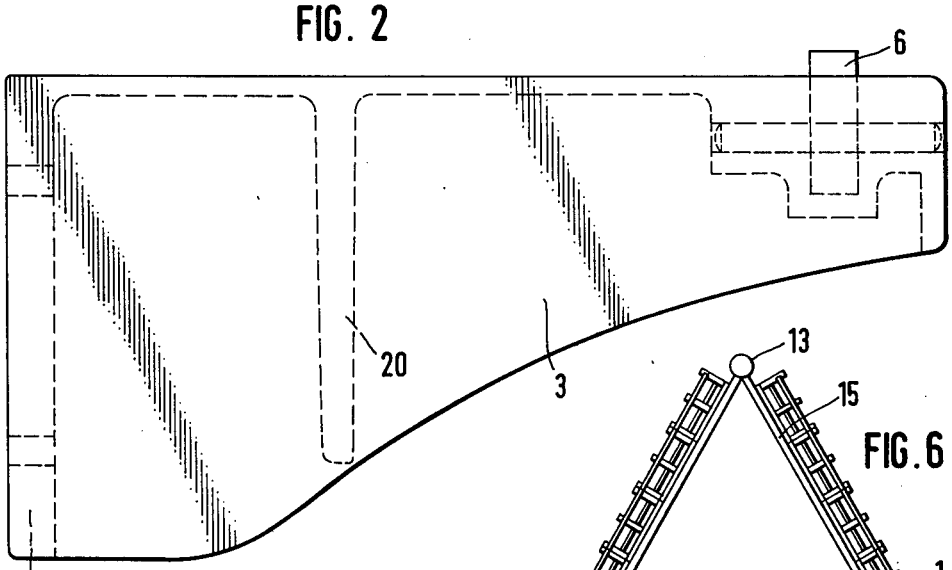
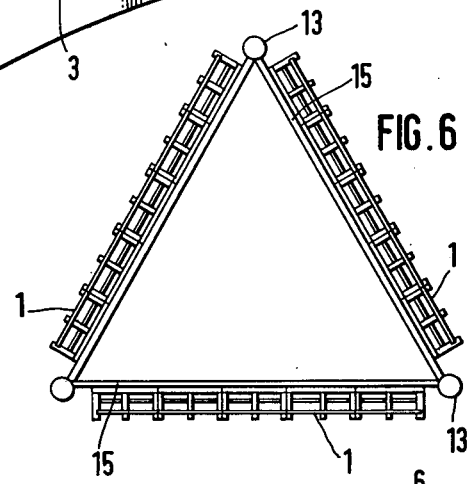
FIG. 6
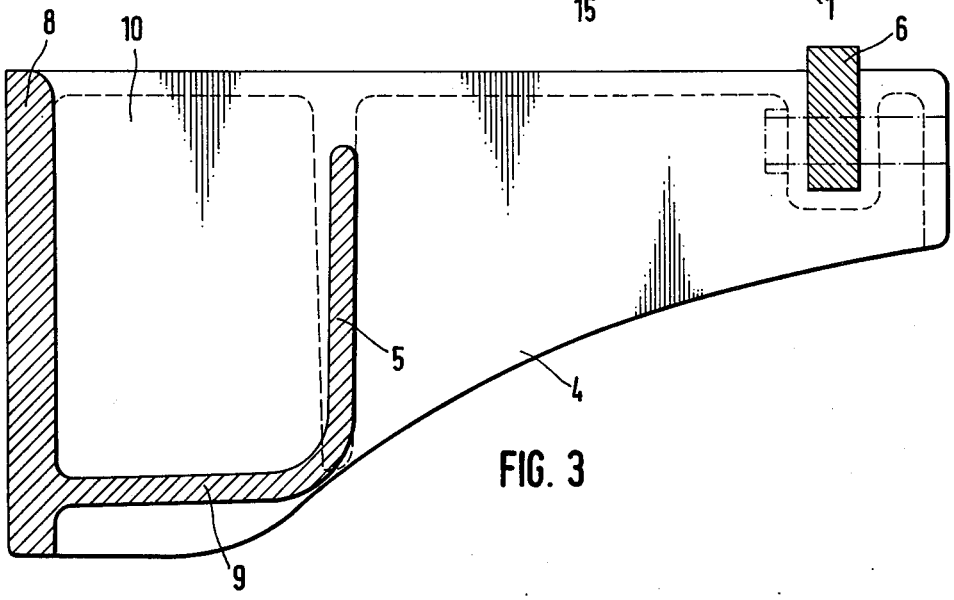
FIG. 3

DEVICE FOR STORAGE OF SKIS

FIELD OF THE INVENTION

This invention is concerned with a device for storing skis.

BACKGROUND OF THE INVENTION

The conventional method of disposal of skis when not in use is to lean the skis, connected in pairs, against a wall. There is a problem here because when they are disposed in a more or less upright position on the wall they are liable to fall sideways. If they are engaged on the ground, at some distance from the wall, there is a danger that the lower ends of the skis will slide away from their support point on the ground; as a consequence this type of storage is unsatisfactory. In addition to this of course, the skis may be damaged when they are knocked or fall down.

OBJECTS AND SUMMARY OF THE INVENTION

It is an object of this invention to provide a device for the storage of skis which avoids these drawbacks. A further object is to provide a device such as will hold the skis firmly in a stored position from which they cannot fall over, even as a result of inattentive handling.

To meet this object, the invention provides a device for storage of skis, characterised by a holder which is adapted to be attached to a wall, a carrier frame or the like and defines at least one compartment for the storage of a pair of skis, this storage compartment being constituted by two arms which extend at right angles to the wall or the like and are spaced by an amount corresponding to at least the width of the skis, a spacer element which extends between the arms at a spacing from the wall which approximately corresponds to the height dimension of the skis in use, and a movable closure element which extends between the free ends of the arms of the compartment.

This arrangement caters for a simple and ordered storage of skis. In using the device, the skis are mounted in the receptacle compartments in such a way that in the case of skis which are connected in pairs the binding and the top of one ski point towards the wall, whilst the binding and tip of the other ski face away from the wall. The spacer element caters for a spacing from the wall such that the projecting parts, and particularly the binding and tips of the skis, will not, in practice, be in contact with the wall and the skis can actually be fully upright. This positioning has also the advantage that no force is applied to the skis themselves which, after being applied for an extended period, might deform the skis or otherwise damage them.

With the closure element in the locked position, the skis cannot tilt away from the wall. Moreover sliding away is prevented, and any lateral movement at all is prevented by the arms. Any sliding away of the lower end from the wall or the like is prohibited by the fact that, with the skis in the perfectly upright position there is practically no force to initiate any such movement and moreover, where positioned in front of a wall, the tip of one ski can bear on the wall which prohibits any such movement. A particular advantage of the invention is that each pair of skis is readily accessible without these skis in any way obstructing adjacent compartments. The storage space required is minimal.

Although the housing of skis connected in pairs will represent normal use of the device according to the invention, it is not essential that the skis shall be a connected pair. The device equally will be used for storage of individual skis or the pairs can be accommodated by the device even in unconnected condition.

The housing of skis of different lengths does not interfere with the proper functioning of the device. Apart from the case of extremely short skis it is always possible to install the device in such a way that that part of the skis between the front end of the binding and the tip will be accommodated in the holder.

The closure element referred to above can take various forms. It may, for example, comprise resiliently mounted parts by means of which the skis can be pushed and held in the compartment defined by the arms of the device and the spacer element. It is preferred, however, for the closure element to be a rigid, but movable part, for example, of stirrup-form or in the form of a swing finger or bar. In the latter event, the closure element may be pivotable on a pin at the free end of one arm, with a fixing device for the finger or bar being provided at the other arm of the compartment. This fixing device may be a lock, for example, a padlock or other type of lock. This may also provide the advantage of making the device theftproof if the closure element is locked and cannot be opened without authority to permit the skis to be taken out of the holder. Removal of the skis from the holder upwards is impossible because of the binding, the dimension of which is greater than the free width of the compartment. Removal of the skis downwards is impossible because the dimensions of the compartment do not allow for any tilting of skis. This also applies in the case of skis which are not connected together in a pair.

In a preferred embodiment of the invention, a lock, for example in the form of a barrel-lock is provided to hold the closure element in its closing position.

Where this closure element is in the form of a pivoting finger or bar, the pivotal axis will advantageously be horizontal. If a special lock or the like is to be used, provision may be made for pivoting of this closure element about an axis of other orientation.

In a modified embodiment of the invention, the closure element is in the form of a press-in stirrup, for example, of U-shape; this element will, for example, be pushed into vertical walls and one limb of the stirrup can cooperate with a lock.

In a preferred embodiment of the invention, use is made of a plate or the like which has at least two arms which project therefrom, in console fashion and are pressed by the spacer element referred to. Instead of using a plate, a structure comprising struts or other constructional parts can be used. The only function of the spacer element is to hold the stored skis at a specific distance from the wall. Apart from this, the spacer element can function to reinforce the arms.

A particularly favourable constructional arrangement uses a plate or the like outstanding therefrom in console fashion and defining two accommodating compartments, the central arm being common to the two compartments. A holder of this kind can be used to accommodate two pairs of skis. Should a larger number of pairs need to be accommodated a corresponding number of holders of the type described can be mounted side-by-side.

Where two compartments are used on one holder, a single lock can be used on the common arm of the holder to fasten the closure elements of the two compartments.

As has been stated above, the spacer element is mounted at a specific distance from the wall. Where the spacer element is flat it can have a bottom constituting an upwardly-open receptacle.

The device according to the invention can be made of metal or other material. Preferably, the plate, the arms, the spacer element and the receptacle referred to can be moulded integrally from a plastics material. In this case it is of advantage for the arms to be of hollow, downwardly-open section. Apart from the fact that this promotes the rigidity, this represents a considerable saving of material and production costs.

The device according to the invention need not necessarily be attached to a wall, but could for example constitute part of a free-standing framework having bearers to which the holders are secured. This enables the device not only to be used in rooms or areas in a building, but, for example, also in the open air. The storage capacity is increased where the holders and their compartments are arranged at both sides of the bearers.

Examples of embodiment of the invention are diagrammatically illustrated in the accompanying drawings, in which:

DESCRIPTION OF THE FIGURES OF THE DRAWING

FIG. 2 is an end view of the device illustated in FIG. 1.

FIG. 3 is a section through the device illustrated in FIG. 1, this section being taken on the line III — III.

FIG. 6 is a plan view of a modified arrangement.

DESCRIPTION OF PREFERRED EMBODIMENTS

Figure 1:
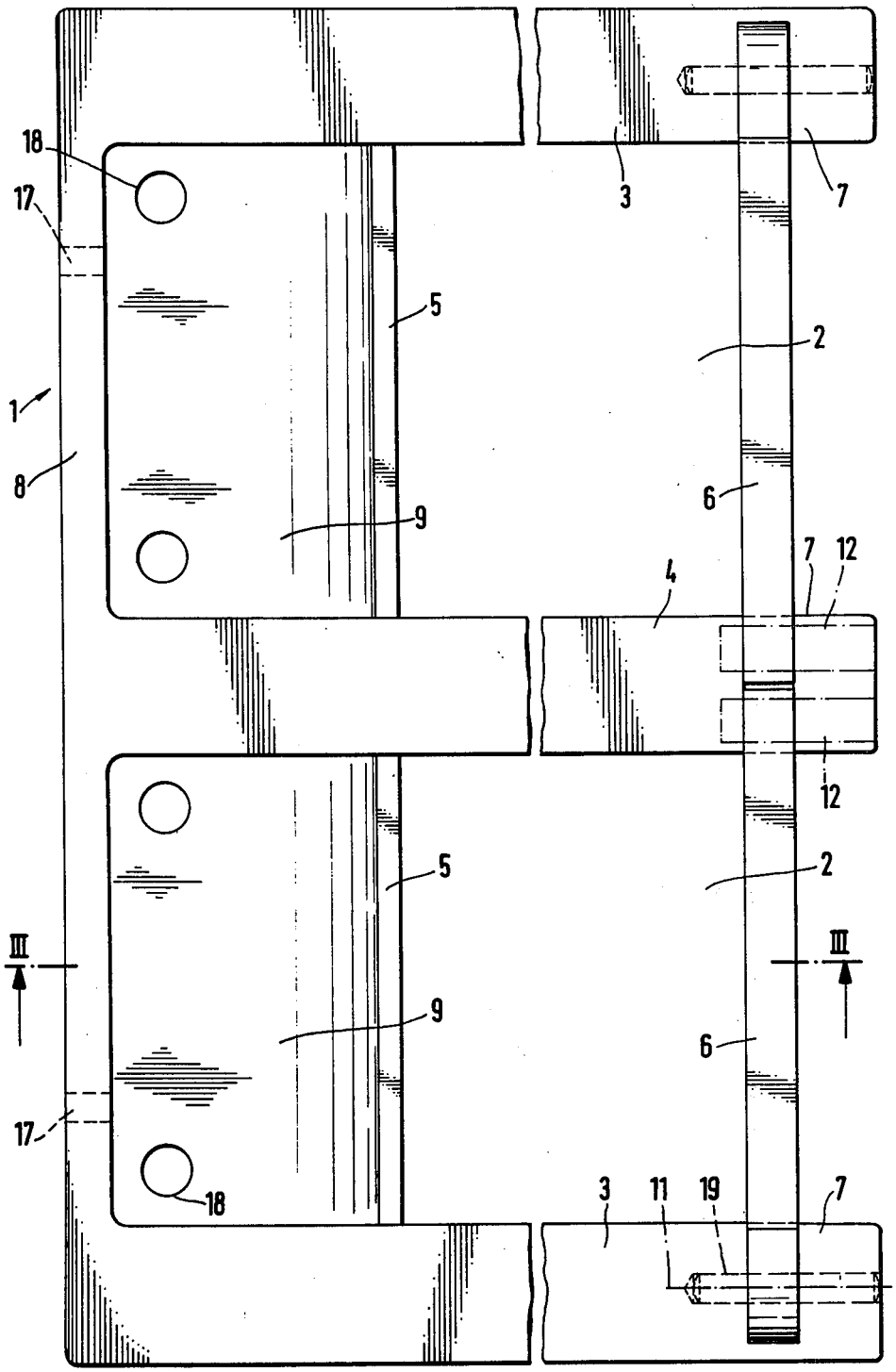
FIG. 1 is a plan view of one embodiment of the ski support device in one version of the invention.

Referring first to FIGS. 1 to 3, the device comprises a holder 1 defining two compartments 2 for receiving pairs of skis. Basically this holder 1 comprises a plate 8 with holes 17 by means of which it can be attached to a wall or similar support. The plate 8 carries arms 3 and 4 between which extends a spacer element 5 having a base 9 connected to plate 8 and defining, with the element 5 a receptacle 10. Holes 18 are provided in the base 9 to enable the holder to be used in the open and to provide drainage holes for disposal of any collected contaminating material.

Closure means 6 are provided at the free ends 7 of the arm 3, these in the case illustrated comprising fingers which are pivotal about pins 19. The arm 4 is is provided with a key-operated lock 12 for holding each of the closure elements or fingers 6. Details of the construction of the lock, which may, for example be of the barrel type, have not been illustrated, not forming an essential part of the invention.

In a modification, the two closure elements 6 may be combined into one element which covers both compartments, in which case a single lock can be used to secure this single element.

In the embodiment illustrated, the arms 3 are hollow with the cavity opening downwards. They comprise ribs 20 for reinforcement purposes.

Figure 4:
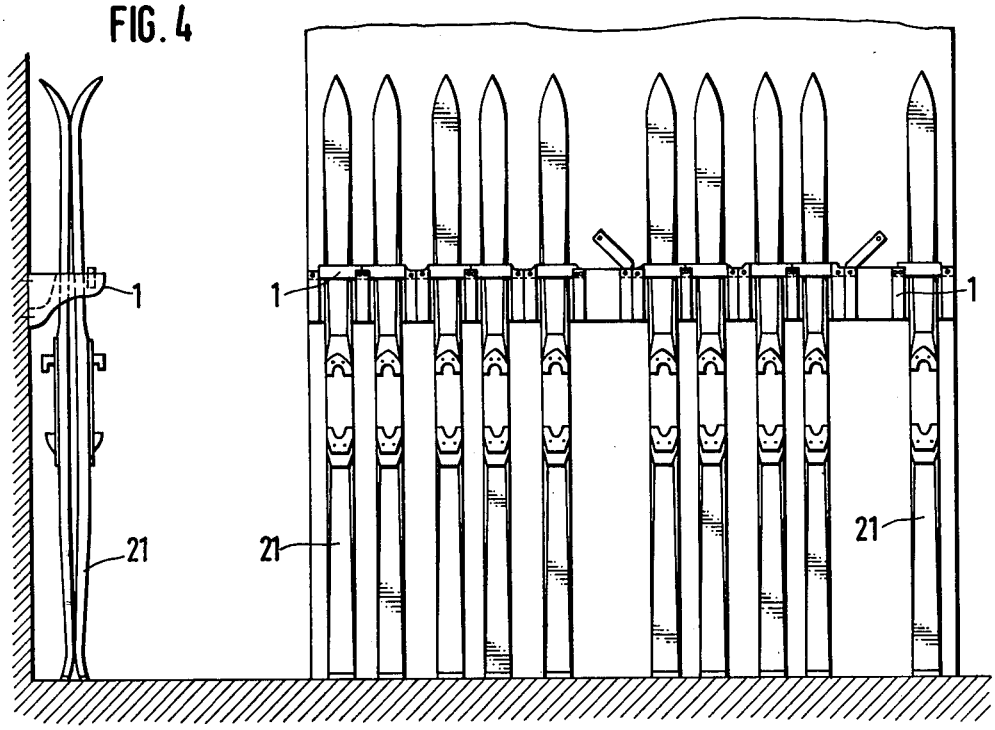
FIG. 4 on a smaller scale illustrates an arrangement showing the use of the device of this invention, as seen from both the front and from the side.

FIG. 4 illustrates an arrangement of a plurality of holders 1 of the type illustrated in FIGS. 1 to 3, disposed side-by-side on a wall to enable a number of skis 21 to be mounted side-by-side. The lefthand part of FIG. 1 gives a side view of the skis as they stand upright spaced from the wall.

Figure 5:
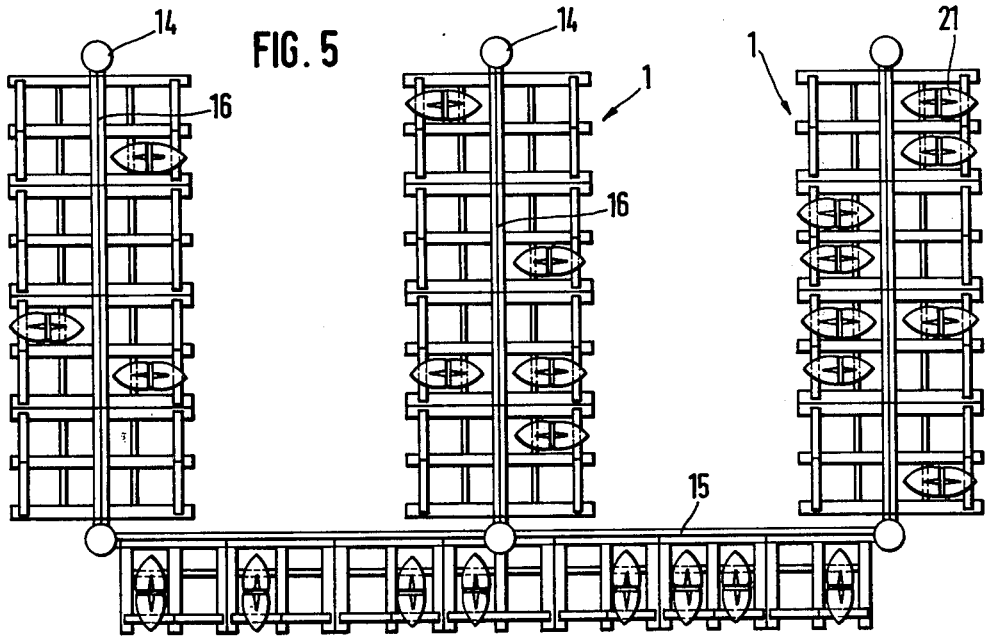
FIG. 5 is a plan view showing other arrangements in accordance with this invention.

The arrangement illustrated in FIG. 5 comprises a framework made up of supports 14 with bearers 15 and 16 extending between them, these bearers themselves carrying a plurality of holders 1. In the arrangement illustrated the bearers 16 have the holders mounted at the two sides thereof, whilst bearer 15 has holders at one side only. The comb-like arrangement which this produces, as seen in plan, allows for a considerable number of skis to be stored and readily accessible. An alternative arrangement is illustrated in FIG. 6 from which it will be observed that the frame 13 with bearers 15 is of triangular disposition as seen in plan.

I claim:

1. A device for storage of skis, comprising a one-piece holder of a synthetic material and which is adapted to be attached to a support to provide at least one compartment for the storage of a pair of skis, said holder comprising at least two downwardly-opening, hollow arms which extend at right angles to the said support and are spaced by an amount corresponding to the width of the skis, an upwardly-opening spacer element which extends integrally between the arms at a distance from said support substantially equal to the height dimension of the skis in use, and a displacable closure element which extends transversely between the free ends of said arms, a back plate integral with and from which said arms extend at right angles, connected to and reinforced by said spacer element, said spacer element comprising an upwardly-open channel form, said closure element comprising a finger element pivotable about a horizontal axis on at least one of said arms and in spaced relation from said spacer element.

2. The structure as claimed in claim 1 including a third arm parallel to said two arms, a second upwardly opening spacer element integral between one of said two arms, and said third arm and in alignment with said first-mentioned spacer element, and a second displaceable closure element similar in structure and function to that first-mentioned and extending between said third arm and said one adjacent arm, the device comprising two adjacent and similarly-functioning, independent, ski-receiving compartments.

3. A device according to claim 1, further including a lock for holding the closure element in a closed position.

4. A device according to claim 1, further including a free standing framework comprising bearers to which a plurality of said holders are secured.

5. A device according to claim 4, in which said holders are arranged at the two sides of a single bearer.

* * * * *